US005325439A

United States Patent [19]

Smiley

[11] Patent Number: 5,325,439

[45] Date of Patent: Jun. 28, 1994

[54] LOUDSPEAKER APPARATUS

[76] Inventor: Jack R. Smiley, Box 14, Rancho Del Sol, Camino, Calif. 95709

[21] Appl. No.: 136,334

[22] Filed: Oct. 13, 1993

[51] Int. Cl.[5] ..... H04R 25/00

[52] U.S. Cl. ..... 381/199; 381/196; 381/203

[58] Field of Search ..... 381/199, 193, 196, 203

[56] References Cited

U.S. PATENT DOCUMENTS 3,832,499 8/1974 Heil ..... 381/196

*Primary Examiner*—Curtis Kuntz
*Assistant Examiner*—Sinh Tran
*Attorney, Agent, or Firm*—Bielen, Peterson & Lampe

[57] ABSTRACT

A loudspeaker apparatus utilizing a ribbon diaphragm which is capable of transforming an electrical signal into an audio acoustical signal. The diaphragm includes a first side and a second opposite side. First and second magnets are also employed in the present invention and are mounted to the edges of the diaphragm such that the diaphragm lies in the magnetic field generated by the pair of magnets. A first plurality of spaced magnetic plates are stacked and extend continuously from the first magnet to the second magnet at the first side of the diaphragm. The first plurality of plates form a throat-shaped cavity of a predetermined size. A second plurality of spaced magnetic focusing plates are stacked on the second side of the diaphragm in the same manner. A plurality of sound damping shims are interposed each of the first plurality of magnetic focusing plates on the sides of the throat-shaped cavity. An acoustic coupler or horn may be easily attached to the throat-shaped cavity to enhance the lower acoustical response range.

12 Claims, 6 Drawing Sheets

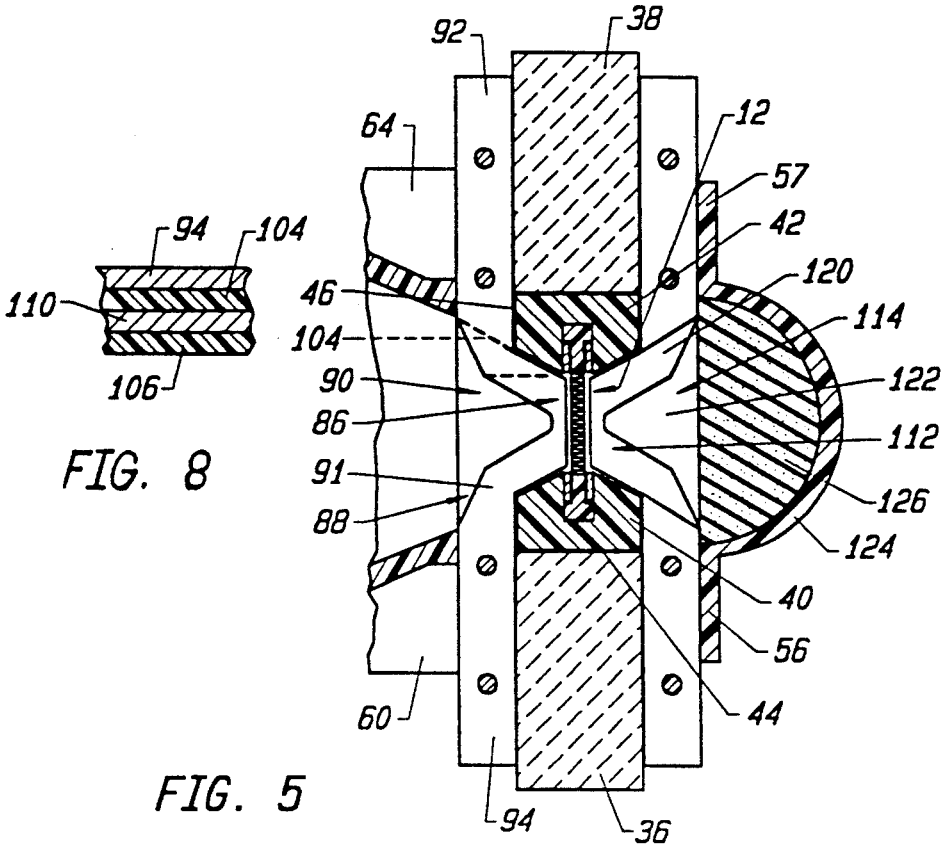
FIG. 8
FIG. 5
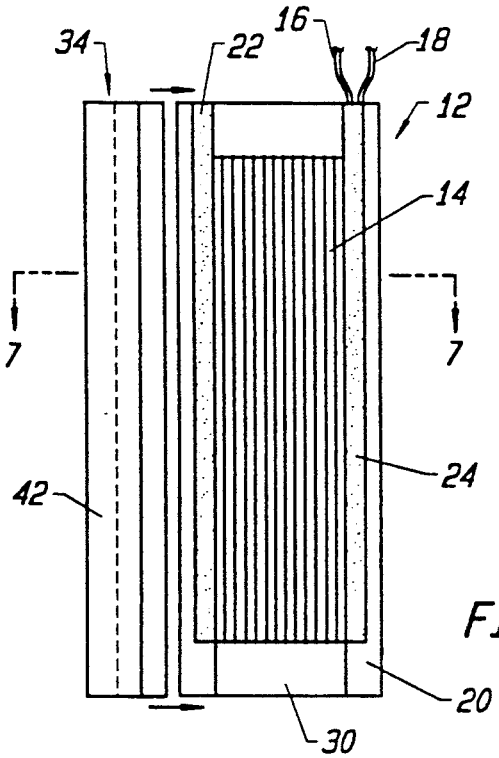
FIG. 6
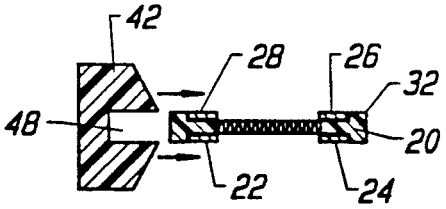
FIG. 7

LOUDSPEAKER APPARATUS

BACKGROUND OF THE INVENTION

The present invention relates to a novel and useful loudspeaker apparatus.

Loudspeaker systems generally employ multiple speakers to cover different sonic ranges of the audio spectrum. Within each portion of the audio spectrum it is highly desirable to maintain a "flat" response in which the decibel output varies a small amount along a particular frequency range. In addition, it is important to produce acoustical energy which is not susceptible to secondary or tertiary harmonic distortions.

Many loudspeaker systems have been proposed in the prior art. It is particularly useful to note the electro-acoustic transducer described in the U.S. Pat. No. 3,832,499 which represents an advance in the acoustical arts. The '499 patent shows a transducer system with a quartet of permanent magnets that are arranged obliquely about a vibrating diaphragm, which includes a metal foil applied to a plastic sheet. Although the transducer described in this patent was a step forward in the art, such transducer lacked an extended range of response and was considered to be of fragile construction. In addition, the coupling of a horn to the transducer of the '499 patent was not successful. This disadvantage prevented the use of certain woofer speakers alone, requiring a mid-range speaker to be used with such a woofer. In addition, the transducer of the '499 patent required a relatively high amount of power for its operation.

A loudspeaker system that is efficient and capable of producing a relatively flat response from the upper limit of a typical woofer to the upper range of human hearing would be a notable advance in the acoustical arts.

SUMMARY OF THE INVENTION

In accordance with the present invention a novel and useful loudspeaker apparatus usable in conjunction with an audio frequency current is herein provided.

The loudspeaker apparatus includes as one of its elements a diaphragm or ribbon which possesses an electrically conductive portion for receiving an audio-frequency current and for producing an audio response therefrom. The diaphragm includes a first side and a second opposite side, as well as a pair of edges therebetween.

A pair of permanent magnets are placed immediately adjacent the edges of the diaphragm such that the diaphragm lies in the magnetic field produced by such pair of magnets. The magnets may be positioned such that a holder of the diaphragm interposes the diaphragm from actual contact with the pair of permanent magnets. Such mounting means for holding the diaphragm between the first and second magnets may permit the easy insertion and removal of the diaphragm from its position between the pair of magnets.

A first plurality of magnetic focusing plates is also included in the present invention. Such first plurality of magnetic focus of focussing plates are stacked in spaced configuration on the first side of the diaphragm and bridge the gap between the first and second magnets. The focus plates are also shaped to provide a throat immediately adjacent the diaphragm. The second plurality of magnetic focus plates are stacked adjacent the second side of the diaphragm and extend from the first and second magnets. Thus, the magnetic field produced by the first and second magnets are efficiency concentrated in the near vicinity of the diaphragm.

A multiplicity of sound dampening shims may be interposed the stacked first plurality of magnetic focusing plates. Such shims would lie at the periphery of the throat formed by the magnetic focusing plates without hindering the vibration of the diaphragm located adjacent the magnetic focusing plates.

A multiplicity of spacers could also be employed to provide the spaced configuration of the first plurality of stacked focusing plates. Thus, any number of such spacers may interleave adjacent focusing plates to provide a uniform spacing therebetween. The sound damping shims would lie in such spaces between the focus plates and adjacent the spacers. Same structure could be provided for the second plurality of stacked focusing plates, save the provision of sound damping shims, which should be considered optional.

The throat formed by the first plurality of stacked focusing plates would be such to permit the connection of a horn or acoustic coupler to the throat portion. The dimension of the throat may be determined by the first plurality of spaced stacked magnetic focusing plates such that horns of various shapes and sizes may be attached to the throat formed by the magnetic focusing plates.

A cap may also be employed in the present invention to cover the second side of the diaphragm and permit acoustic energy to emanate only from the first side of the diaphragm. On the other hand, since the diaphragm is essentially driven in two directions, a bi-directional acoustic generator or speaker may be formed on the first and second sides of the diaphragm. In this regard, a horn may be coupled to the second side of the diaphragm at a throat formed by the second set of spaced magnetic focusing plates found thereat.

It may be apparent that a novel and useful loudspeaker apparatus has been herein described.

It is therefore an object of the present invention to provided a loudspeaker apparatus which is capable of producing an acoustical response having an extended frequency range with a very low distortion.

It is another object of the present invention to provide a loudspeaker apparatus which is capable of using an acoustical signal along an extended range or frequency with reduced harmonic distortion and at a very high efficiency.

Another object of the present invention is to provide a loudspeaker apparatus which is efficient and durable in construction.

A further object of the present invention is provided to a loudspeaker system which utilizes a diaphragm in a magnetic field and includes means for eliminating standing wave and diffraction effect distortion in the immediate vicinity of the diaphragm.

A further object of the present invention is to provided a loudspeaker system which is capable of being connected to an acoustic coupler or horn which extends the range of the low frequency response of the loudspeaker system.

Yet another object of the present invention is to provide a loudspeaker system which is easily coupled to a woofer to provided a full spectrum of audible frequencies without the use of a separate mid-range speaker or speakers.

Another object of the present invention is to provide a loudspeaker apparatus which includes permanent magnets that are efficiently controlled to eliminate stray magnetic fields and produce an extremely high flux density in the vicinity of the diaphragm which is capable of transforming an electrical signal into an acoustic signal.

Yet another object of the present invention is to provide a loudspeaker apparatus which may be operated in a uni-directional or bi-directional manner.

Another object of the present invention is to provide a loudspeaker apparatus which maintains a uniform "flat" response through its operating range.

The invention possesses other objects and advantages especially as concerns particular characteristics and features thereof which will become apparent as the specification continues.

BRIEF DESCRIPTION OF THE DRAWINGS

FIG. 5 is a sectional view taken along line 5—5 of FIG. 2.

FIG. 6 is a front elevational view of the diaphragm and a diaphragm holder separated therefrom.

FIG. 7 is a sectional view taken along line 7—7 of FIG. 6.

FIG. 8 is a sectional view taken along line 8—8 of FIG. 3, showing the interleaving of focus plates and damping shims.

For a better understanding of the invention references made to the following detailed description of the preferred embodiments thereof which will be referenced to the prior described drawings.

DETAILED DESCRIPTION OF THE PREFERRED EMBODIMENTS

Various aspects of the present invention will evolve from the following detailed description of the preferred embodiments which should be taken in conjunction with the prior described drawings.

Figure 1:
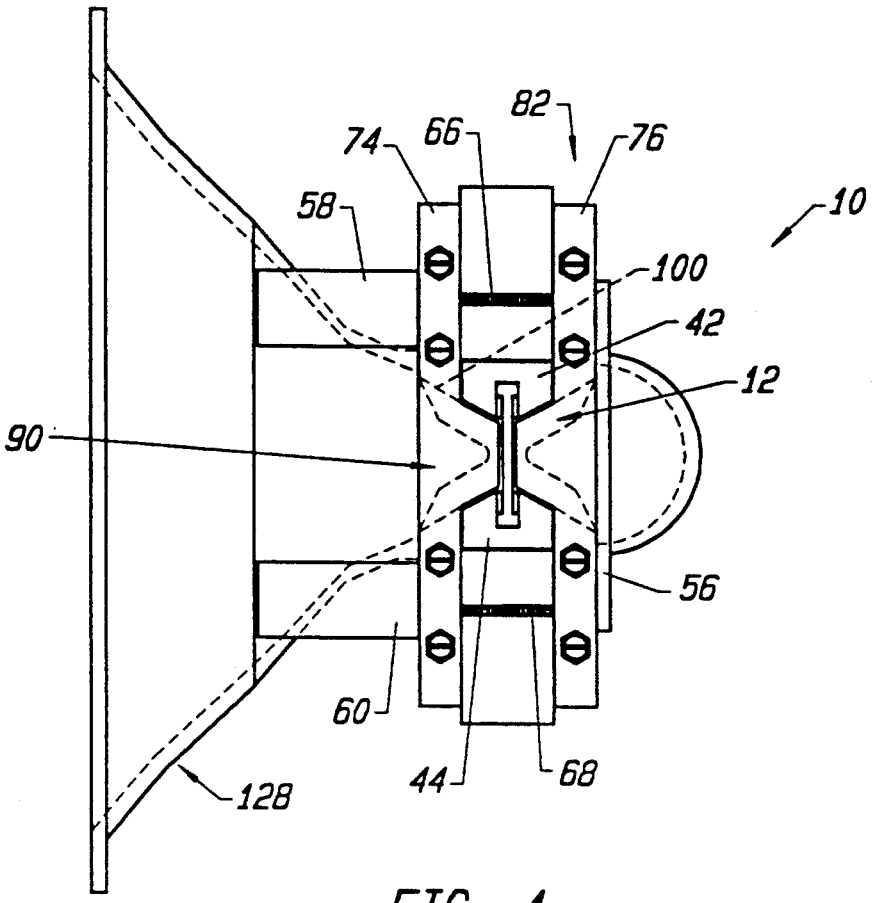
FIG. 1 is a top plan view of the speaker apparatus of the present invention.
Figure 4:
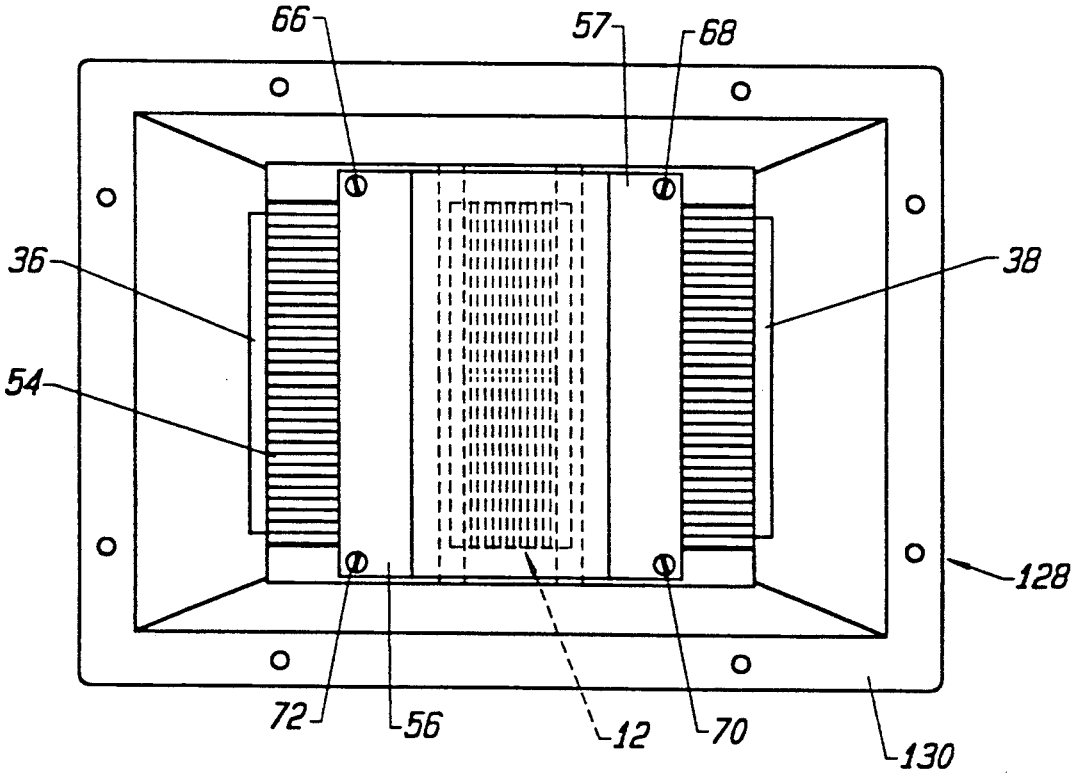
FIG. 4 is a rear elevational view of the speaker apparatus of the present invention.

The invention as a whole is depicted in the drawings by reference character 10. The speaker apparatus 10 includes as one of its elements a ribbon or diaphragm 12 which is of a construction known in the prior art. Namely, diaphragm 12 includes a pleated Mylar sheet of material 14 combined with metal strips, described in the U.S. Pat. 3,832,499, which is incorporated herein by reference in its entirety. Conductors 16 and 18 carry the electrical current generated by a suitable electrical-acoustical system (not shown). As understood in the prior art, such audio-frequency current will cause diaphragm 12 to vibrate in a suitable magnetic field. Frame member 20 formed of rigid or semi rigid material such as plastic, wood and the like, surrounds diaphragm 12 and holds the same within apparatus 10, as will be described in further detail hereinafter. Strips 22, 24, 26 and 28 are attached to the outer surfaces 30 and 32 of frame member 20. Strips 22, 24, 26 and 28 are constructed of sound damping material such as a foam plastic. It has been found that the use of strips 22, 24, 26 and 28 eliminates undesirable acoustical anomalies from a desired flat response believed to originate with frame member 20, FIGS. 6 and 7. Mounting means 34 is also provided in the present invention for holding a diaphragm 12 in place between permanent magnets 36 and 38. Mounting means 34 includes a pair of blocks 40 and 42, FIGS. 5–7 which slide along surfaces 44 and 46 of permanent magnets 36 and 38, respectively. With reference to FIG. 7, it may be observed that block 42 includes an exemplar slot 48 for frictionally engaging frame 20 for securing diaphragm 12. It should be noted that block 40 also includes an identical slot for the same purpose. A plurality of metallic spacers are alternately found in stacks 52 and 54. Magnets 36 and 38 are sandwiched between stacks 52 and 54 in intimate contact with plurality of spacers 50. It should be observed that plurality of spacers 50 may be magnetic in nature. Plates 56 and 57 and a quartet of bosses 58, 60, 62 and 64, sandwich stacks 52 and 54, including plurality of spacers 50. Bolts 66, 68, 70 and 72 fasten plate 56 to bosses 60, 62, 64 and 66, thus sandwiching the plurality of spacers 50 and magnets 36 and 38 therebetween, FIG. 4. In addition, top brackets 74 and 76 are held to bottom brackets 78 and 80 by multiplicity of bolts and nuts 82, best shown in FIG. 1. Brackets 74 and 76 compress stacks 52 and 54 in a direction orthogonal to bolts 66, 68, 70 and 72.

Figure 2:
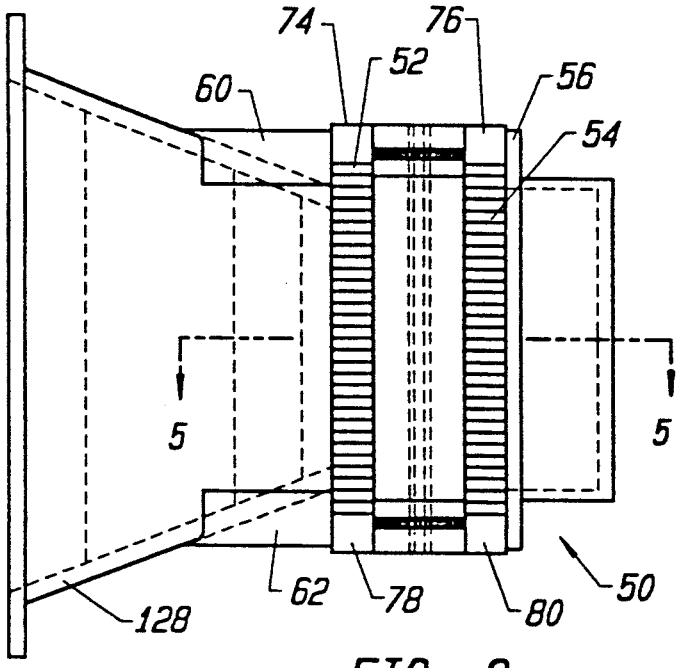
FIG. 2 is a side elevational view of the speaker apparatus of the present invention.
Figure 3:
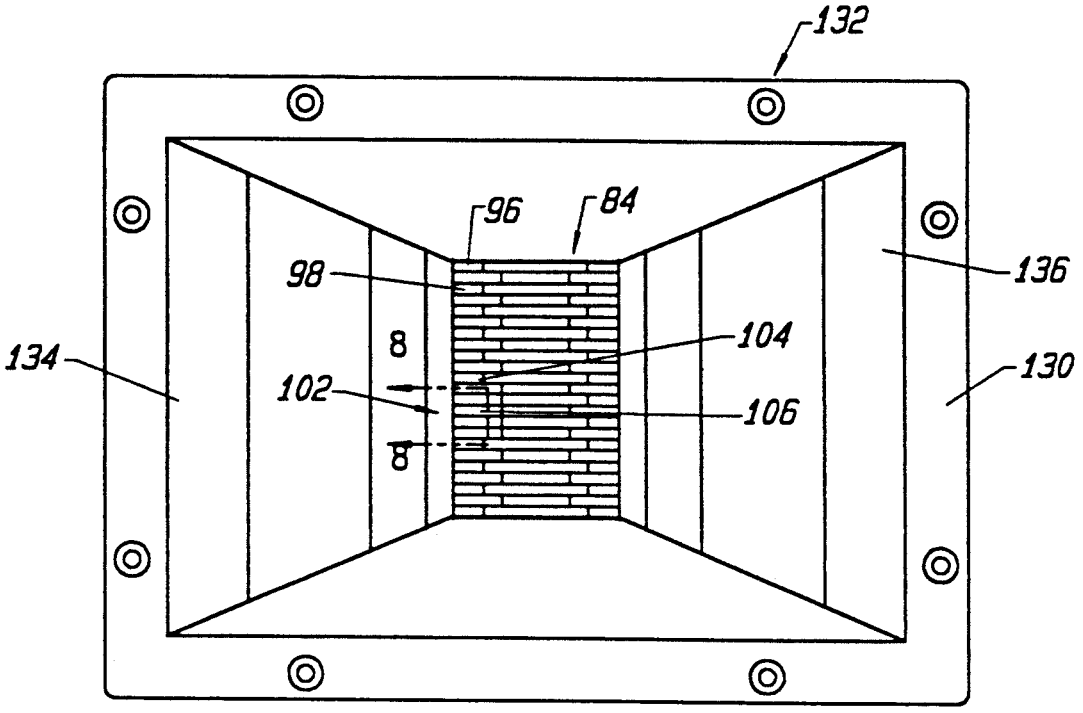
FIG. 3 is a front elevational view of the speaker apparatus of the present invention.

A first plurality of magnetic focusing plates 84 are stacked adjacent first and second magnets 36 and 38 on first side 86 of diaphragm 12, FIG. 3. With reference to FIG. 5, it may be observed that plurality of focus or focusing plates such as focus plate 88 are roughly U-shaped to form a throat 90 of a pre-determined size, FIGS. 1 and 5. Typical focus plate 88 includes a central boomerang-shaped portion 91 having wings 92 and 94 which extend over alternating layers of metal spacers 50 and wings of other focus plates 84. Thus, the stack 52 viewed in FIG. 2, represents such alternating layers of spacers 58 and focus plates 84. With reference to FIG. 3, a spacer 96 alternates with a focus plate 98. As such, spacer 96 includes a mitred edge 100, shown in plan view on FIG. 1 in phantom. Further, a plurality of triangular shaped shims 102 constructed of sound damping material may be interposed alternate focusing plates at the sides of the throat area 90 formed by such focusing plates. With reference to FIGS. 3 and 8, shims 104 and 106 have been placed between focus plates 108 and 110 in this regard. It must be stressed, that plurality of shims 102 may be placed between any of the plurality of spaced focusing plates 84 in throat area 90.

Second side 112 of diaphragm 12 includes a second plurality of magnetic focus plates 114 which are stacked and interleaved by plurality of spacers 50 in stack 54. Likewise, stack 54 represents the edges alternating magnetic spacers 50 and second plurality of magnetic focusing plates 114 on FIG. 2. Returning to FIG. 5, it should be noted that spacers 116 and 118 are depicted as overlying magnetic focus plate 120. Since diaphragm 12 is bi-directional, sound could be generated on second side 112 of diaphragm 12 through the throat 122 formed by second plurality of magnetic focus plates 114. However, in the embodiment depicted, a cap 124 has been employed and integrally formed with plates 56 and 57 to enclose a core 126 of sound absorbing material, best illustrated in FIG. 5.

Returning to first side 86 of diaphragm 12, it may be apparent that acoustic coupler or horn 128 extends from throat 90. Horn 128 is formed integrally with bosses 58, 60, 62 and 64 described, hereinbefore. Horn 128 terminates in an end flange 130 having a plurality of openings 132 for connection to a speaker enclosure. Horn 128 may take any shape and size, but is depicted in the drawings as having a flare of approximately 40 degrees in the vertical direction and 60 degrees in the horizontal direction. Side walls 134 and 136 are faceted in the horizontal direction.

Figure 9:
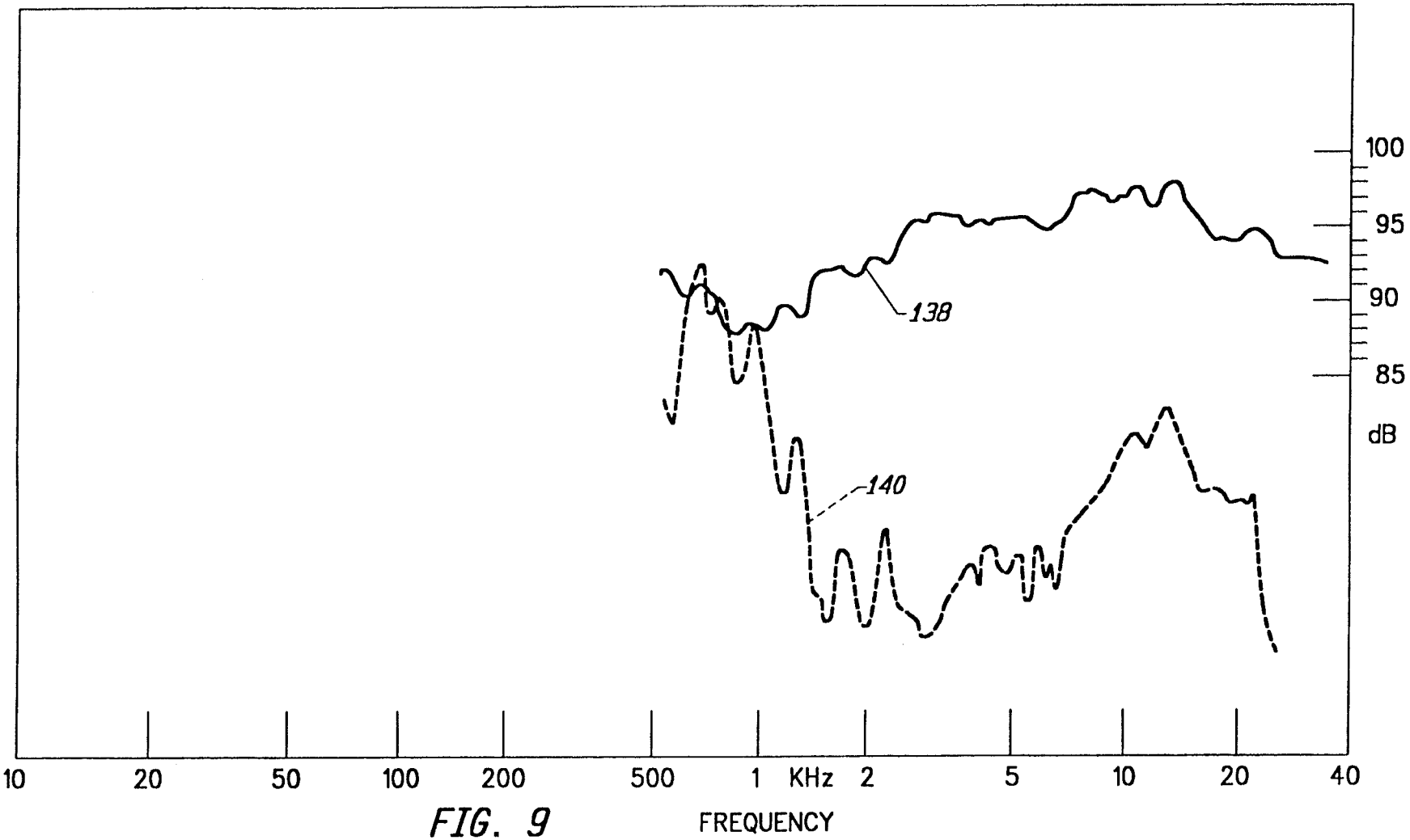
FIG. 9 PRIOR ART
FIG. 9 is a graphical representation of acoustical intensity versus frequency for the prior art transducer described in U.S. Pat. No. 3,832,499.
Figure 10:
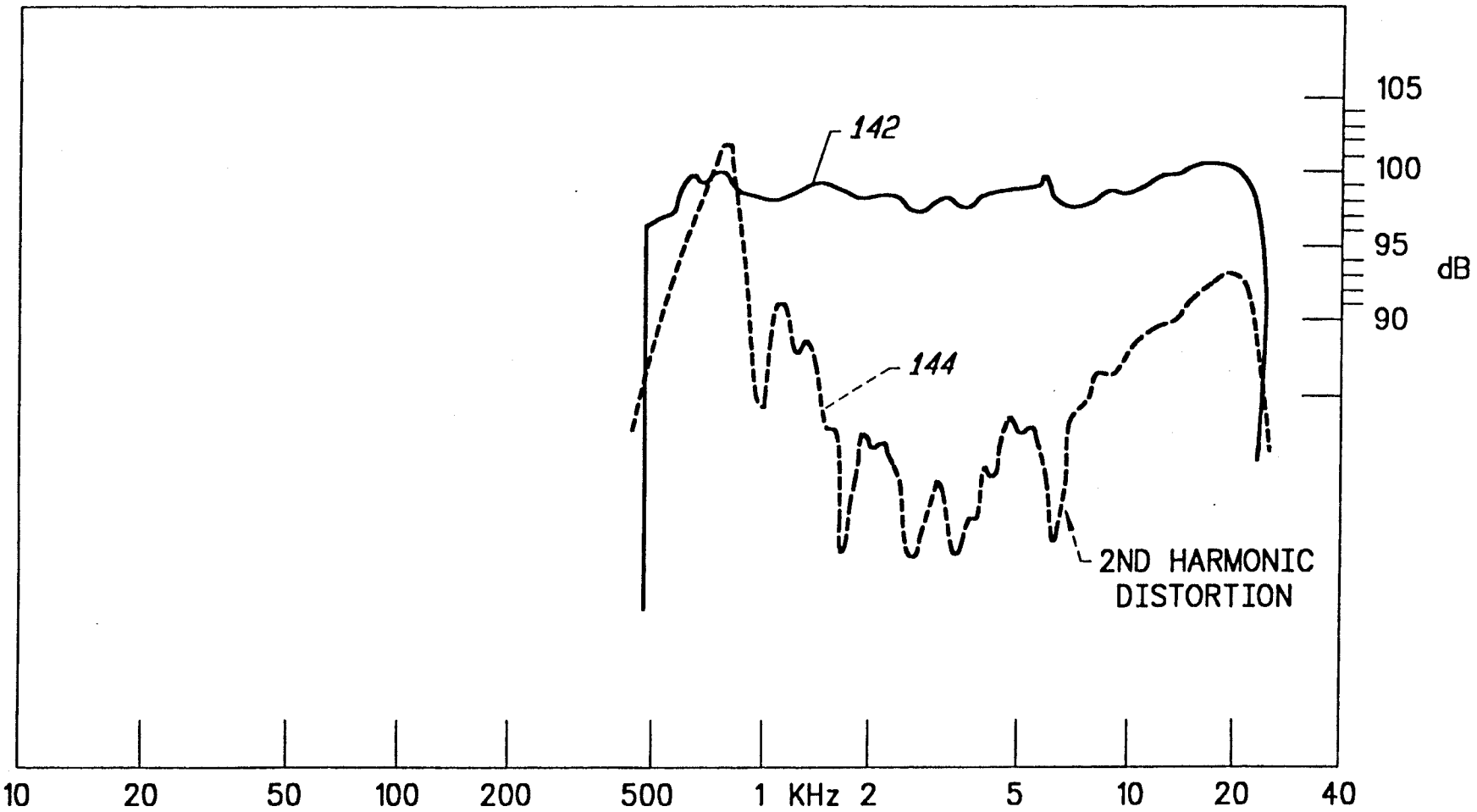
FIG. 10 is a graphical representation of acoustical intensity versus frequency for the speaker apparatus of the present invention utilizing a five inch deep horn flaring 40 degrees in the vertical direction and 60 degrees in the horizontal direction.
Figure 11:
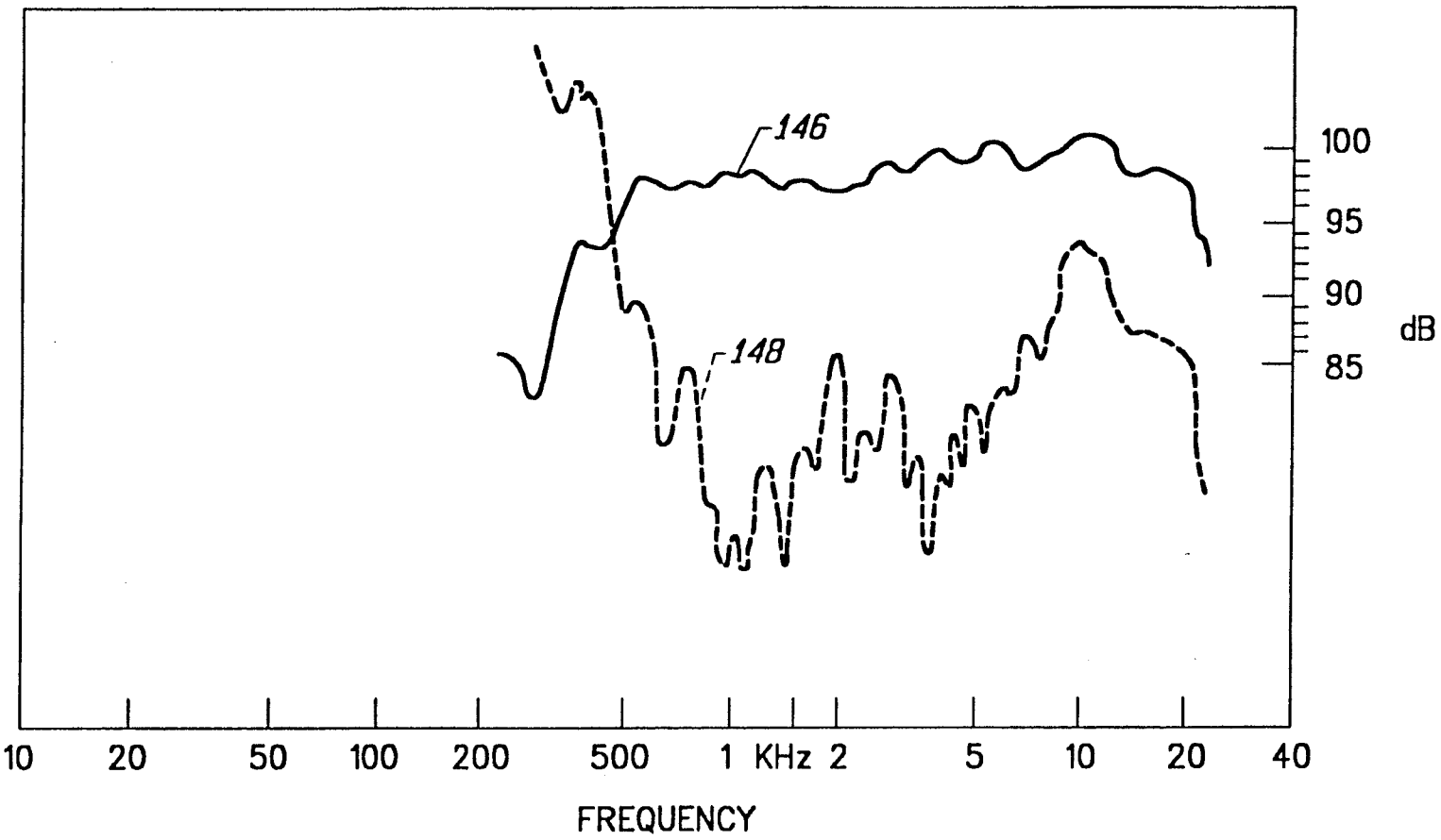
FIG. 11 is a graphical representation of acoustical intensity versus frequency for the speaker apparatus of the present invention utilizing a six inch deep horn flaring 40 degrees in the vertical direction and 60 degrees in the horizontal direction.

In operation, an audio-frequency current signal is transmitted through conductors 16 and 18 to diaphragm 12. Diaphragm 12 vibrates in the magnetic field provided by permanent magnets 36 and 38. Acoustical waves or sound emanates from diaphragm 12 and is directed outwardly through throat 90 which is formed to a pre-determined size by first plurality of spaced magnetic focusing plates 84, separated by plurality of magnetic spacers 50. The same may be said of throat 122 on second side 112 of diaphragm 12 when speaker apparatus 10 is to be employed bi-directionally. However, in the embodiment shown in the drawings, cap 124 and core 126 render the speaker system unidirectional, such that the sound waves substantially only travel through throat 90. Horn 128 is coupled to stack 52 of alternating spacers and focus plates through bosses 58, 60, 62 and 64 integrally formed with horn 128. A plurality of sound damping shims 102 may be interspaced first plurality of magnetic focusing plates 84 and throat 90. It has been found that such use of sound damping shims eliminates diffraction anomalies or diffraction distortions in the throat 90 area of speaker apparatus 10. With reference to FIG. 9, acoustical response is plotted utilizing the prior art transducer found in U.S. Pat. No. 3,832,499. Line 138 represents such response while dashed line 140 represents the second harmonic distortion. The acoustic response generally centers about 94 decibels and includes relatively large intensity variation from a frequency of 2,000 kilohertz to 20,000 kilohertz. The lower limit of 2,000 kilohertz indicates that the prior art transducer placed in a speaker system would require a woofer as well as a mid-range speaker to complete the range of frequencies detected by the human ear. Turning to FIG. 10, it may be observed that the acoustical response of the speaker of the present invention utilizing the apparatus depicted in FIGS. 1–8 with plurality of sound damping shims 102 placed in every space between alternating magnetic focusing plates 84 in throat 90. In addition, the apparatus utilized to obtain the results shown in FIG. 10 included a horn 128 which is five inches deep with a mouth area of 150 square inches. The vertical flare was approximately forty degrees while the horizontal flare was sixty degrees. The throat 90 formed by plurality of magnetic focusing plates 84 was one inch wide by three and one-half inches tall. It may be observed, the response line 142 is essentially flat at 99–100 decibels to approximately 800 hertz at the lower frequency range, where the second harmonic distortion line 144 intersects response line 142. FIG. 11 depicts a response line 146 which shows extension of the lower usable range of the present invention to 500 hertz, where second harmonic line 148 intersects, line 146, by substituting a six inch horn and larger diaphragm 12. In such cases, only a woofer would be employed with the apparatus 10 of the present invention to achieve a full range response. In any case, the response indicated is considered a reference value for other speakers of the prior art. In generating the data reflected in FIGS. 9–11 a heterodyne analyzer, type 2010 and distortion control unit, type 1902, distributed by B & K Components Ltd. of Buffalo, N.Y., was employed to perform a frequency sweep of the speaker systems being compared. The data was obtained using a UAO196 Hale inch calibrated microphone measured in an anechoic chamber. A B & K type 2307 Level Recorded charted the data. Moreover, the 4–5 decibel increase represented by the speaker apparatus of the present invention, FIGS. 10 and 11, represent approximately a one-hundred and fifty percent increase in efficiency over the prior art. It is believed, that this is due to the magnetic intensity in the throat area of the speaker apparatus of the present invention which has been measured as 7,500 gauss. This compares favorably to 3,500 gauss exhibited by the speaker system shown in the U.S. Pat. No. 3,832,499 patent.

While, in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A loudspeaker apparatus used in conjunction with an audio-electrical signal comprising:

a. a diaphragm including an electrically conductive portion for receiving the audio-electrical signal and producing an audio responsive output, said diaphragm including a first side and a second opposite side;

b. a first magnet;

c. a second magnet;

d. mounting means for holding said diaphragm between said first and second magnets and in the fields of said first and second magnets;

e. a first plurality of magnetic focusing plates in stacked spaced configuration, each plate of said plurality of plates extending continuously from said first magnet to said second magnet adjacent or along said first side of said diaphragm and said first plurality of magnetic focusing plates forming a throat of pre-determined size; and f. a second plurality of magnetic focusing plates in stacked configuration extending from said first magnet to said second magnet adjacent or along said second side of said diaphragm.

2. The loudspeaker apparatus of claim 1 in which said throat further includes outwardly extending flared portions.

3. The loudspeaker apparatus of claim 1 which additionally comprises a plurality of sound damping shims interposed each of said first plurality of spaced magnetic focusing plates.

4. The loudspeaker of claim 2 which additionally comprises an acoustic coupler sealingly engaging said flared portions of said throat and extending outwardly therefrom.

5. The loudspeaker apparatus of claim 1 in which said mounting means comprises a plurality of magnetic spacers interleaved with each of said first plurality of magnetic focusing plates.

6. The loudspeaker apparatus of claim 5 in which said mounting means further includes a pair of blocks to engage two opposite edges of said diaphragm, said pair of blocks being sandwiched between said first plurality of magnetic focusing plates and said interleaved spacers and said second plurality of focusing plates.

7. The loudspeaker apparatus of claim 1 which additionally comprises a core of sound damping material held against said second plurality of focusing plates.

8. The loudspeaker apparatus of claim 1 which additionally comprises a frame for supporting said diaphragm, and a plurality of strips of sound damping material fixed to said frame.

9. The loudspeaker apparatus of claim 8 in which said mounting means further includes a pair of holding blocks to engage said frame of said diaphragm, said pair of blocks being sandwiched between said first plurality of magnetic focusing plates and said second plurality of focusing plates.

10. The loudspeaker apparatus of claim 1 which additionally includes an acoustic coupler having a multiplicity of mounting bosses adjacent said first plurality of magnetic focusing plates, a plate adjacent said second plurality of magnetic focusing plates, and fastening means for connecting said multiplicity of mounting bosses to said plate.

11. The loudspeaker apparatus of claim 1 in which said first and second magnets are located at opposite edges of said diaphragm between said first and second side of said diaphragm.

12. The loudspeaker apparatus of claim 9 which further includes a pair of brackets and means for supporting said first plurality of magnetic focusing plates between said pair of brackets.

* * * * *